United States Patent [19]

Kiyokane

[11] Patent Number: 4,516,793

[45] Date of Patent: May 14, 1985

[54] ADVERTISING ARTICLE AND METHOD OF MAKING SAME

[75] Inventor: Jerrilyn C. Kiyokane, Long Beach, Calif.

[73] Assignee: Namkung Promotions Inc., Costa Mesa, Calif.

[21] Appl. No.: 473,953

[22] Filed: Mar. 10, 1983

[51] Int. Cl.[3] ..... B42D 15/00; B41L 1/20

[52] U.S. Cl. ..... 283/103; 282/25

[58] Field of Search ..... 283/56, 103, 1 R; 282/25

[56] References Cited

U.S. PATENT DOCUMENTS

| | | | |
|---|---|---|---|
| 1,567,875 | 12/1925 | Swanson | 282/25 |
| 1,853,622 | 3/1932 | Kennedy | 283/56 |
| 1,896,834 | 2/1933 | Brown | 283/103 |
| 3,290,812 | 12/1966 | Hunkins | 283/56 |
| 3,718,277 | 2/1973 | Volkert | 283/56 |
| 3,807,771 | 4/1974 | Greason | 283/56 |
| 4,011,985 | 3/1977 | Simson | 283/56 |
| 4,307,900 | 12/1981 | Krautsack | 283/56 |

FOREIGN PATENT DOCUMENTS

| | | | |
|---|---|---|---|
| 772046 | 11/1967 | Canada | 283/56 |
| 2427195 | 12/1979 | France | 283/1 R |

*Primary Examiner*—Paul A. Bell
*Assistant Examiner*—Paul M. Heyrana, Sr.
*Attorney, Agent, or Firm*—James E. Brunton

[57] ABSTRACT

A combined advertising and redeemable coupon device formed from a single printed sheet which is uniquely folded to provide an attractive one piece packet for displaying advertising indicia of the merchant. The body of the device is perforated to define a plurality of redeemable coupons which are hidden from view when the device is in a folded display configuration.

3 Claims, 5 Drawing Figures

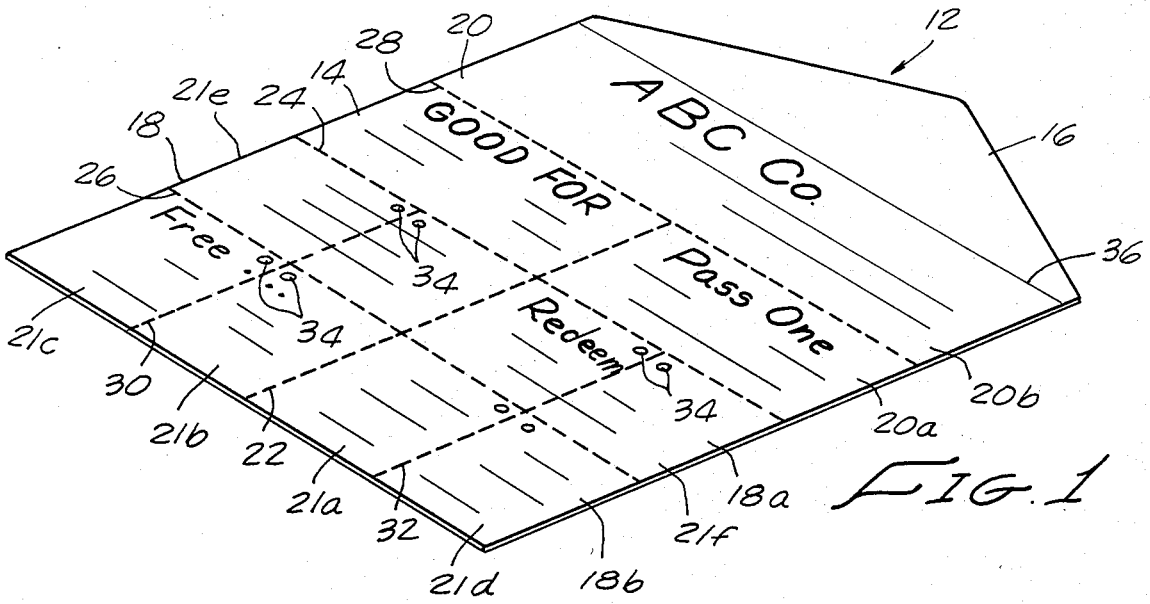
FIG. 1
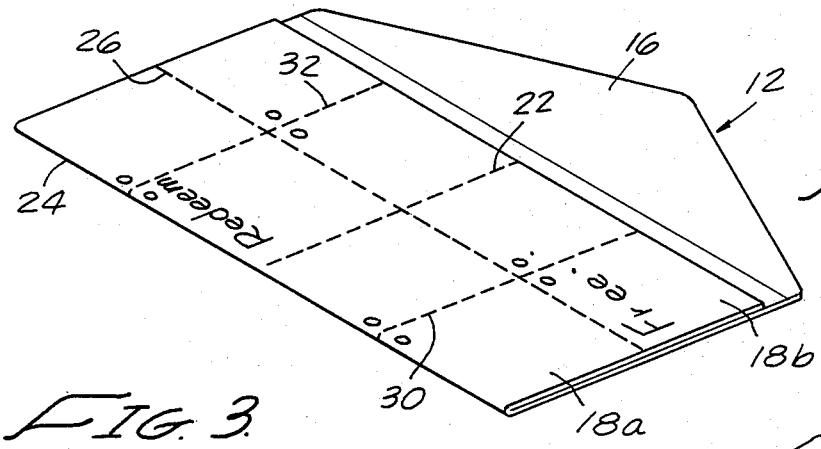
FIG. 2.
FIG. 3.
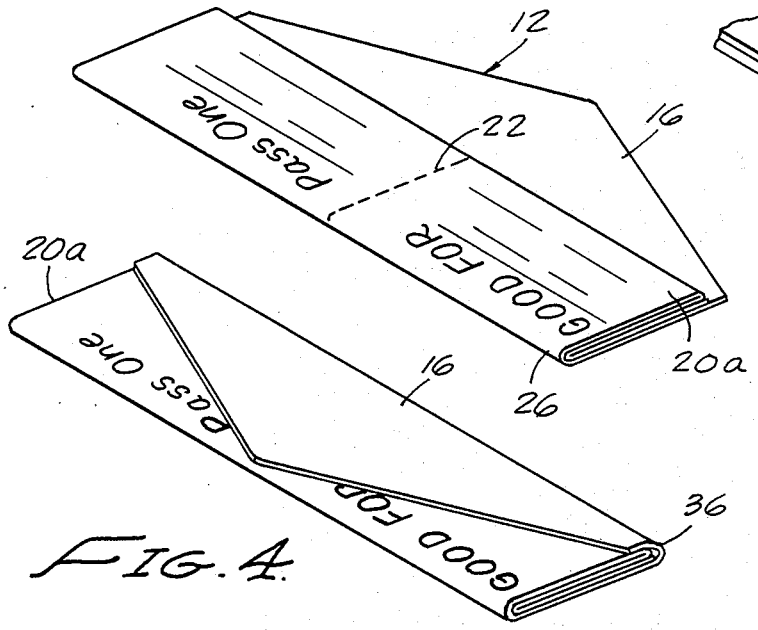
FIG. 4.
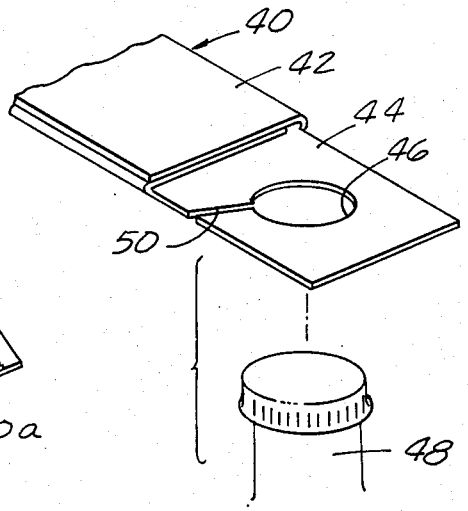
FIG. 5.

ADVERTISING ARTICLE AND METHOD OF MAKING SAME

BACKGROUND OF THE INVENTION

1. Field of the Invention

The present invention relates generally to advertising devices and more particularly relates to an advertising device having a plurality of redeemable coupons which are substantially hidden from view when the device is in its normal advertising display configuration.

2. Discussion of the Prior Art

Advertising brochures, hang tags and redeemable coupons are, or course, not new. Many merchants advertise their goods and services by means of printed fliers and the like. Additionally, many merchants offer coupons to their customers for redemption at a later date for free or discounted goods or services. The use of such coupons is popular because it encourages the customer to return to the merchant's place of business thereby stimulating future business.

In recent years the sale of redeemable coupons has also become popular and merchants frequently offer for sale booklets containing redeemable coupons. Such advertising approaches have been particularly popular in connection with fast food outlets.

Also popular are joint venture advertising schemes whereby two or more merchants cooperate in redemption programs. For example, under such programs a customer who buys a soft drink from one manufacturer may be given coupons which may be redeemed for goods, such as fast foods, produced by a second merchant.

Although advertising programs using redeemable coupons have become increasingly popular, little imagination has been shown in the development of appropriate vehicles for the distribution of the coupons. Frequently, coupons are individually dispensed, or are dispensed in small unattractive booklets. This is undesirable because the coupons are often lost or misplaced. Further, the advertising impact of the program is not fully realized because of the drab and unimaginative way in which the coupons are printed and distributed.

The device of the present invention overcomes the drawbacks of prior art coupon type advertising and for the first time provides an attractive and highly novel means for effectively implementing redeemable coupon advertising programs. In use, the advertising device of the present invention permits effective advertising and exposure by the merchant, while at the same time taking full advantage of the redeemable coupon type of promotion.

SUMMARY OF THE INVENTION

It is an object of the present invention to provide an advertising device and method of making same in which effective advertising displays and redeemable coupons are combined into a highly attractive folded wallet-like device which is constructed from a single planar sheet having advertising indicia and coupon information printed on one side thereof.

It is another object of the invention to provide a device of the aforementioned character and the method of making same in which the planar sheet after having been printed can be die cut, folded and then glued all on a straight line gluer of standard construction to form an attractive display item in which the merchant's name and advertising is exposed to view, but the coupon information is substantially hidden from view until the device is unfolded.

It is another object of the invention to provide a device of the character described in the preceding paragraphs in which the printed planar sheet can expediciously be perforated to define a plurality of redeemable coupons which can be removed by the customer from the sheet one at a time for periodic redemption.

It is another object of the invention to provide a device as described in the preceding paragraph in which the individual coupons are apertured proximate their corners to receive rings or the like so that the coupons can be used as gift tags or separate display items.

It is still another object of the invention to provide a device of the class described which includes a unique apertured tab which permits the wallet-like device to be hung about the neck of a bottle such as used to contain soft drinks and the like.

It is a further object of the invention to provide an advertising device of the aforementioned character which can expediciously be printed, cut and folded in large volume at an extremely rapid rate and at very low cost.

BRIEF DESCRIPTION OF THE DRAWINGS

FIG. 1 is a generally perspective view of the advertising device of the invention in its unfolded configuration.

FIG. 2 is a generally perspective view of the advertising device shown in FIG. 1 as it appears after it has been turned over and the first fold has been made.

FIG. 3 is a generally perspective view similar to FIG. 2, but showing the appearance of the device after the second fold has been made.

FIG. 4 is a generally perspective view of the device as it appears in its display configuration with the tab of the device having been folded over and releasably fixed to one of the coupon portions of the device.

FIG. 5 is a fragmentary, generally perspective view of another form of the invention having a laterally protruding, apertured tab adapted to be positioned about the neck of a bottle.

DESCRIPTION OF PREFERRED FORMS OF THE INVENTION

Referring to the drawings, and particularly to FIG. 1, the advertising device of the present invention, generally designated by the numeral 12, comprises a single planar sheet 14 having indicia printed on a first side thereof with the reverse, or second side thereof being blank. In the form of the invention shown in FIG. 1, the device includes an upper tab portion 16, a lower coupon portion 18 and an intermediate portion 20. The intermediate portion 20 includes a lower redeemable coupon portion **20*a* and an upper advertising portion 20*b*. Lower coupon portion 18 is divided into first and second portions 18*a* and 18*b* and is bisected by a perforated line 22 so that four separate coupons are defined within lower portion 18** of the device.

In making the advertising device of the present invention, a single sheet of planar material is first imprinted on one side with suitable advertising and coupon indicia and then is cut to a pre-determined size and shape to form a shaped sheet of a selected configuration such as is shown by way of example in FIG. 1. Next the shaped sheet is perforated along a first line 24 which divides portions 18 and 20 along a second line 26 which horizontally bisects portion 18. Line 26 divides portion 18 to form the previously identified first and second coupon portions 18*a* and 18*b*. Perforations are also made along a third line 28 which horizontally bisects intermediate portion 20 so as to form third and fourth portions 20*a* and 20*b*. As indicated in FIG. 1, portion 20*b* has imprinted thereon advertising indicia as, for example, indicia identifying the name of the company distributing the advertising device. The third portion 20*a* comprises a coupon portion having two separate redeemable coupons 21*a* and 21*b*.

After the horizontal perforations 24, 26 and 28 have been made, the shaped sheet is then perforated along the previously identified fourth line 22, which line extends substantially perpendicularly to the first, second and third lines and substantially vertically bisects the first, second and third portions 18*a*, 18*b* and 20*a*. Once perforation 22 has been made, the shaped sheet is essentially divided into an advertising display portion 20*b*, and at least six removable redemption coupon portions 21*a*, 21*b*, 21*c*, 21*d*, 21*e* and 21*f*. As previously mentioned, these coupon portions may be conveniently detached along the perforated line and may be redeemed for free or discounted merchandise from either the merchant distributing the advertising device or for merchandise or services of other merchants cooperating in the preparation and distribution of the device.

So that coupons 21*a* and 21*e* can be used as gift tags, the planar sheet is scored along a fifth line 30 extending substantially perpendicular to first and second lines 24 and 26 and substantially vertically bisecting these coupon portions. Similarly coupon portions 21*d* and 21*f* are scored by a perpendicularly extending sixth line 32. By thus scoring the coupon portions, when the individual coupons are removed from the planar sheet along the perforations 18, 24 and 22, they may be conveniently folded to form a booklet-like hang tag. A plurality of apertures 34 are provided on opposite sides of the lines 30 and 32 and are located proximate the upper portions of the coupons. As best seen in FIG. 1, apertures 34 are located so that when the individual coupons are folded over along lines 30 and 32 they will be in alignment to permit insertion of a ring or length of ribbon which can then be used to hang the coupons, or to affix them to a gift package or the like.

After the planar sheet has been printed, perforated and scored in the manner described in the preceding paragraphs, it is then folded in the following manner into the display configuration shown in FIG. 4: First, the shaped sheet is folded along the first line 24 to form a folded sheet wherein the second, or blank sides of the lower and intermediate portions 18 and 20 respectively are brought into engagement. The appearance of the device after the first fold has been made is illustrated in FIG. 2. Note that in FIG. 2, the sheet is shown as it would appear after having been turned over from the configuration shown in FIG. 1 and then folded in the manner described.

The next fold is made by folding the folded sheet of FIG. 2 along second line 26 so as to bring the first, or printed, sides of coupon portions 18*a* and 18*b* into engagement. As indicated in FIG. 3, after this fold has been made, the indicia imprinted on coupon portion 20*a* is then brought into view but the indicia on the coupon portions 18*a* and 18*b* is concealed from view.

With the device in the configuration shown in FIG. 3, tab portion 16 is then folded over along a line 36 which divides the tab portion 16 and the intermediate portion 20. Having folded the tab portion 16 over portion 20*a* as shown in FIG. 4, the tab portion is then removably affixed to portion 20*a* by the use of a small amount of bonding material or by any other suitable connection means. However, the connection means selected must be one which can readily be broken to permit the device to be unfolded by the customer.

It is apparent through analysis of FIG. 4 that, with the device in the display configuration thus shown, the coupon portions of the device are substantially concealed from view. However, if the device is turned over from the position shown in FIG. 4, the advertising indicia, including the name of the company as imprinted on portion 20*b* is readily viewable. With this arrangement, the merchant's name and whatever advertising material he may wish to imprint on portion 20*b* is always visible to the consumer when the device is in its display configuration. Only after the temporary bonding of the tab 16 to portion 20*a* is broken and the device unfolded into the configuration shown in FIG. 1 is the information imprinted on the coupon portion of the device brought into full view of the customer. This feature adds an element of intrigue to the device of the invention and improves its effectiveness as an advertising medium.

With the device unfolded as shown in FIG. 1, it is apparent that the customer may remove one or more of the coupons from the device and redeem them, or alternatively may use them as hang tags on packages or other gifts which may be given to third parties.

Referring to FIG. 5, there is shown yet another form of the advertising device of the present invention. In this form of the invention, generally designated in FIG. 5 by the numeral 40, the planar sheet having the advertising indicia imprinted thereon is substantially similar to that shown in FIG. 1, save that the tab portion 42 is rectangular rather than triangular in configuration. Additionally, the device as shown in FIG. 5 further includes a laterally extending tab portion 44 having provided therein an aperture 46 adapted to be removably received over the neck of a beverage containing bottle such as is identified in FIG. 5 by the numeral 48. A slot 50 extending from the edge portion of the tab portion to the periphery of the aperture 46 expedites positioning of the device over the neck of the bottle 48.

In using the device of the configuration shown in FIG. 5, it may be conveniently attached to soft drink bottles or other beverages or it may be attached to bottles used for containing shampoos, soaps, cleansing liquids and the like. This, of course, enables the advertising device to be used in conjunction with a wide variety of products normally sold in bottle type containers.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A method of making a device for use in advertising comprising the steps of: p1 (a) printing indicia on a first side of a planar sheet having first and second sides;

(b) cutting said planar sheet to form a shaped sheet having an upper tab portion, a lower portion and an intermediate portion;

(c) perforating said shaped sheet along a first line dividing said lower and intermediate portions, along a second line bisecting said lower portion to form first and second portions and along a third line bisecting said intermediate portion to form third and fourth portions, said fourth portion having advertising indicia imprinted thereon;

(d) perforating said shaped sheet along a fourth line extending substantially perpendicular to said first, second and third lines, said fourth line substantially bisecting said first, second and third portions to form an advertising display portion and at least six removable, redeemable coupon portions;

(e) folding said shaped sheet along said first line to form a folded sheet wherein the second sides of said lower and intermediate portions are in engagement;

(f) folding said folded sheet along said second line to bring the first sides of said first and second portions into engagement;

(g) folding said tab portion of the device thus formed along a line dividing said tab portion and said intermediate portion to bring the second side of said tab portion into engagement with the first side of said third portion; and (h) removably affixing said second side of said tab portion to said third portion to form an advertising device displaying advertising indicia on said fourth portion but substantially concealing said redeemable coupons from view.

2. A method as defined in claim 1 including the steps of scoring said planar sheet along a fifth line extending substantially perpendicular to said first, second and third lines and bisecting said coupon portions disposed on one side of said fourth line and scoring said planar sheet along a sixth line extending substantially perpendicular to said first, second and third lines and bisecting said coupon portions disposed on the opposite side of said fourth line said scoring being adapted to facilitate bending said coupon portions upon removal thereof from said shaped sheet.

3. A method as defined in claim 2 including the step of punching a plurality of apertures in said shaped sheet at locations proximate the intersection of said first, second and fifth lines and proximate the intersections of said first, second and sixth lines.

* * * * *